US006453227B1

(12) United States Patent
Kalafut et al.

(10) Patent No.: US 6,453,227 B1
(45) Date of Patent: Sep. 17, 2002

(54) METHOD AND APPARATUS FOR PROVIDING A DISPLAY OF A WORK MACHINE AT A WORK SITE

(75) Inventors: James J. Kalafut, Peoria; Robert J. Price, Dunlap, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/738,837

(22) Filed: Dec. 16, 2000

(51) Int. Cl.[7] ..... E02F 9/26; G06F 19/00
(52) U.S. Cl. ..... 701/50; 701/300
(58) Field of Search ..... 701/50, 213, 208, 701/211, 300; 340/995; 37/414, 415, 416; 342/357.06, 357.13

(56) References Cited

U.S. PATENT DOCUMENTS 5,631,658 A 5/1997 Gudat et al.
5,864,060 A 1/1999 Henderson et al.

FOREIGN PATENT DOCUMENTS

JP 1-312129 * 12/1989

* cited by examiner

*Primary Examiner*—Michael J. Zanelli
(74) *Attorney, Agent, or Firm*—Steve D. Lundquist

(57) ABSTRACT

A method and apparatus for providing a display of a work machine at a work site. The work machine has a work implement controllably attached. The method includes the steps of determining a position of the work machine relative to the site, determining a position of the work implement relative to the work machine, and displaying a scaled image of the site, the work machine, and the work implement relative to the work machine, wherein movement of the work implement relative to the work machine is shown.

11 Claims, 5 Drawing Sheets

METHOD AND APPARATUS FOR PROVIDING A DISPLAY OF A WORK MACHINE AT A WORK SITE

TECHNICAL FIELD

This invention relates generally to a method and apparatus for displaying a work machine at a work site and, more particularly, to a method and apparatus for displaying a work implement relative to the work machine at the work site.

BACKGROUND ART

Work machines are increasingly taking advantage of advances in technologies which allow an operator to view various facets of the work operation on a display. The operator thus has the advantage of one or more views of the work operation which is not normally available without a display.

For example, in earthworking operations, a display may offer an operator views of the terrain being worked on, i.e., altered, as work takes place, that would not be viewable to the operator from the cab of the work machine. Thus, the work operations may be performed more efficiently and accurately, without subjecting the operator to the harshness of the environment outside the cab.

Some of the features of modern displays include real time display of the terrain; that is, the level of the terrain as earthworking operations are performed. In addition, multiple views may be displayed. For example, a top view and a side profile view of the work operations is typically shown. Furthermore, a display of an icon of the work machine, for example, an earthworking machine, may be shown to give the operator some idea of the location of the work machine relative to the terrain.

However, displays to date do not show much more than icons of the general work machine and perhaps of a work implement as it performs work operations. These icons give an operator a general sense of the position of the work machine and work implement, but are not designed to give the operator a view of all portions of the work machine and work implement as movement takes place. Thus, the display is limited in the amount and quality of information provided to the operator.

The present invention is directed to overcoming one or more of the problems as set forth above.

DISCLOSURE OF THE INVENTION

In one aspect of the present invention a method for providing a display of a work machine at a work site is disclosed. The work machine has a work implement controllably attached. The method includes the steps of determining a position of the work machine relative to the site, determining a position of the work implement relative to the work machine, and displaying a scaled image of the site, the work machine, and the work implement relative to the work machine, wherein movement of the work implement relative to the work machine is shown. In another aspect of the present invention an apparatus for providing a display of a work machine at a work site is disclosed. The work machine has a work implement controllably attached. The apparatus includes a position determining system for determining a position of the work machine relative to the site, means for determining a position of the work implement relative to the work machine, a display located on the work machine, and a controller for receiving position information of the work machine and the work implement, and responsively delivering a signal to the display for displaying a scaled image of the site, the work machine, and the work implement relative to the work machine, wherein movement of the work implement relative to the work machine is shown.

BEST MODE FOR CARRYING OUT THE INVENTION

Figure 1:
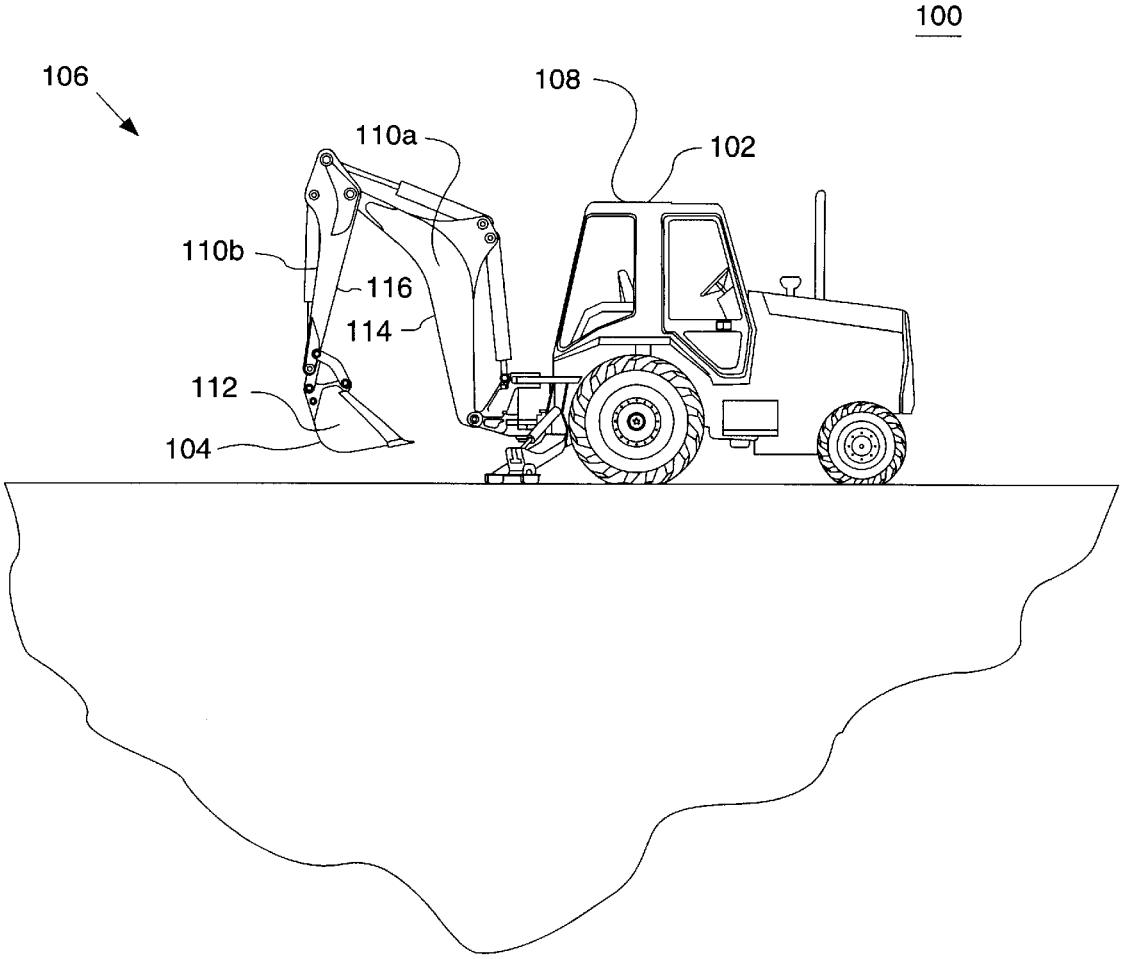
FIG. 1 is a diagrammatic illustration of a work machine at a work site.

Referring to the drawings, a method and apparatus 100 for providing a display 208 of a work machine 102 at a work site 106 is disclosed. The work machine 102 preferably has a work implement 104 controllably attached.

With particular reference to FIG. 1, a work machine 102 is shown at a work site 106. The work machine 102 includes a work implement 104 controllably attached. In the preferred embodiment, the work implement 104 is attached to the work machine 102 by a plurality of linkages 110. For example, two linkages 110*a,* 110*b* are shown in FIG. 1.

The work machine 102 of FIG. 1 is depicted as an excavating machine, in particular a backhoe loader. However, other types of excavating machines, e.g., excavators, front shovels, trenchers, and the like, could be used with the present invention. The excavating machine in FIG. 1 includes a work implement 104 shown as a bucket 112, connected to the excavating machine by linkages 110 commonly known as a boom 114 and a stick 116. However, the work implement 104 could be of some other type, e.g., blade, boring tool, ripper, and the like.

Figure 2:
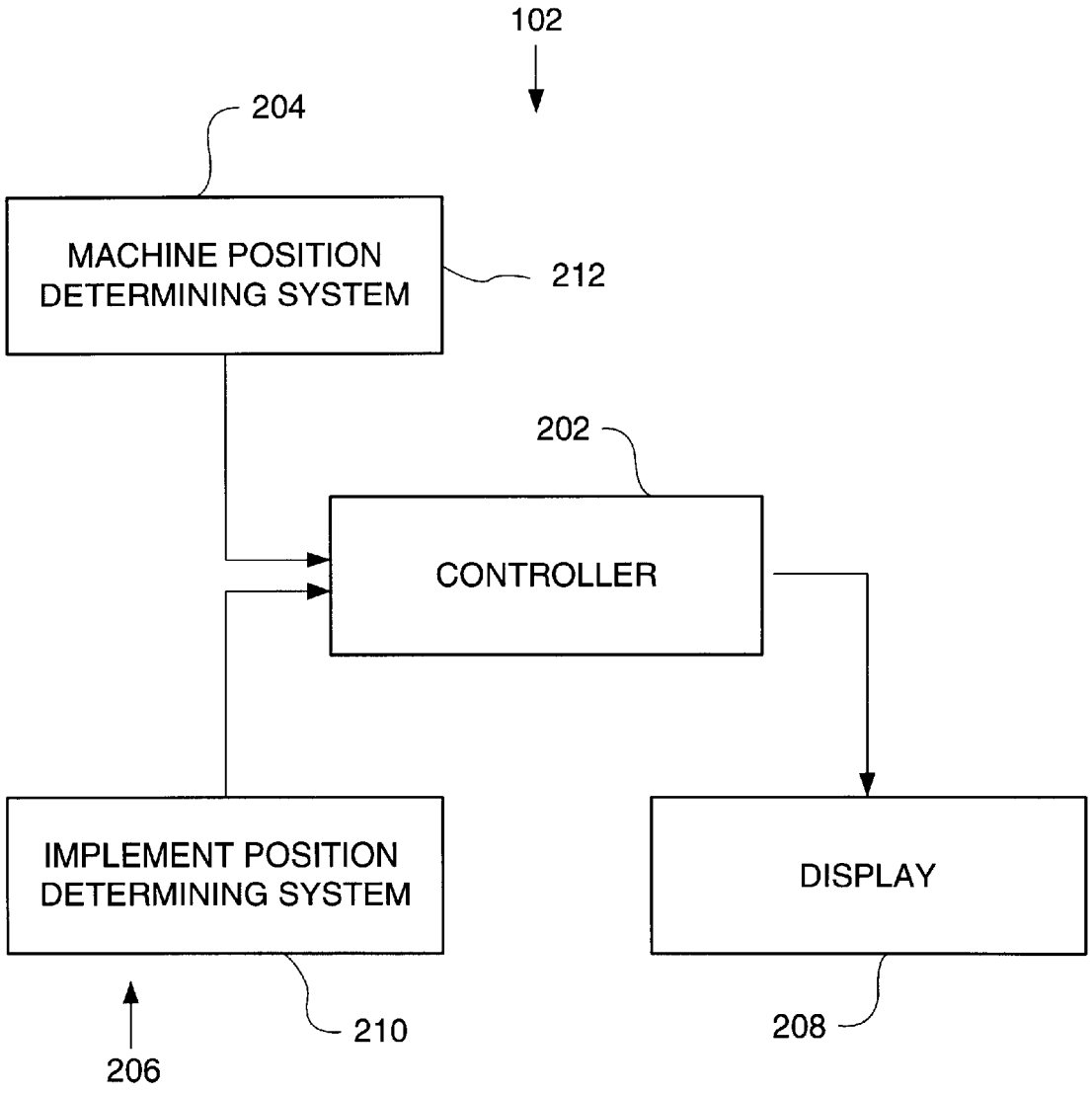
FIG. 2 is a block diagram illustrating a preferred embodiment of the present invention.

Referring to FIG. 2, a block diagram illustrating a preferred embodiment of the present invention is shown. A machine position determining system 204, located on the work machine 102, is adapted to determine a position of the work machine 102 relative to the work site 106. Preferably, the machine position determining system 204 determines the position of the work machine 102 in site coordinates, such as Cartesian, i.e., x,y,z coordinates, polar coordinates, latitude-longitude coordinates, or some other like system.

In the preferred embodiment, the machine position determining system 204 includes a global position satellite (GPS) system. However, other types of position determining systems, such as laser plane referencing, dead reckoning, and the like, could be used as well.

A means 206 for determining a position of the work implement 104, located on the work machine 102, is adapted to determine the position of the work implement 104 relative to the work machine 102. Preferably, the means 206 for determining the position of the work implement 104 includes an implement position determining system 210.

Figure 4:
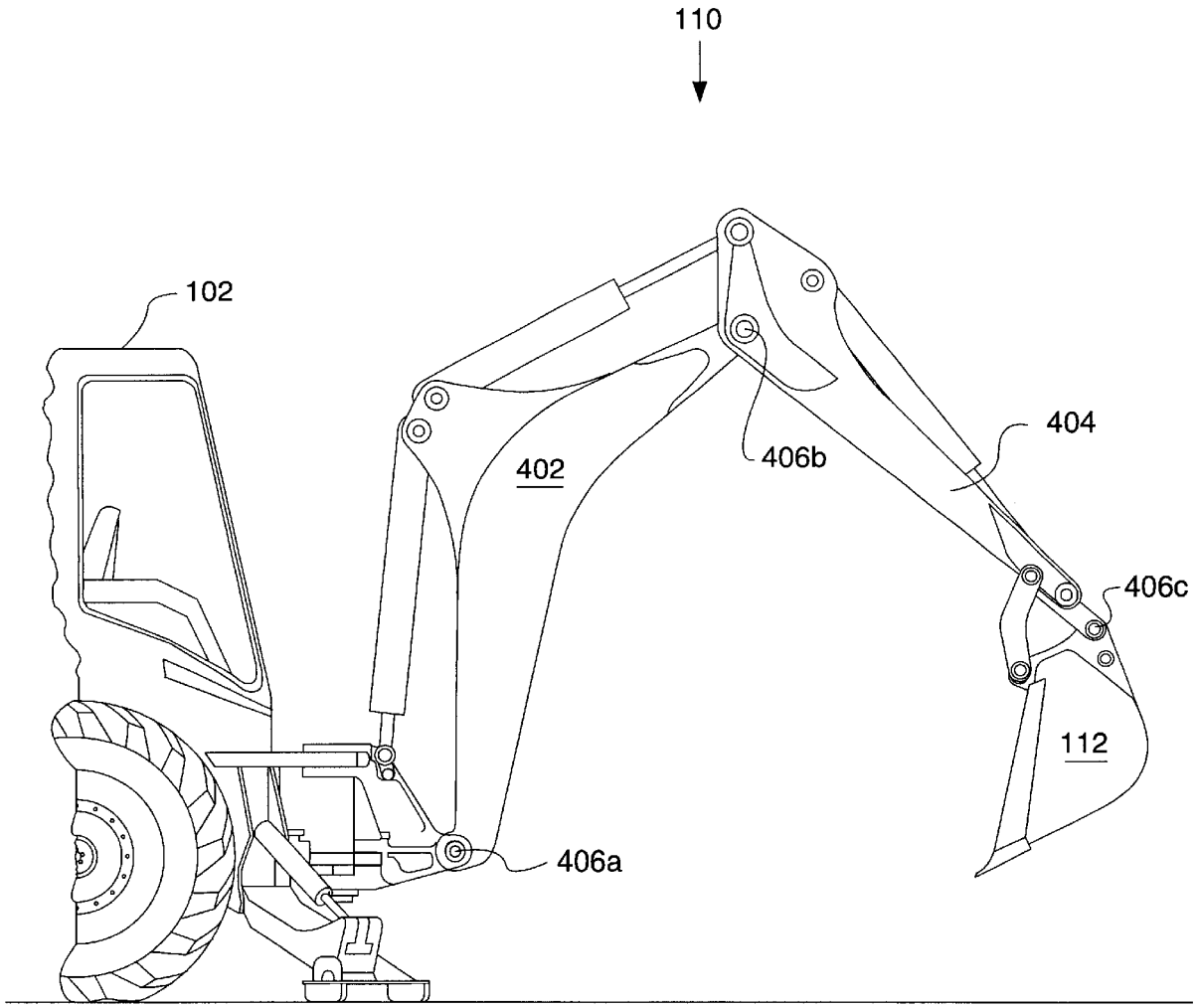
FIG. 4 is a diagrammatic illustration of a portion of a work machine including a work implement.

An exemplary implement position determining system 210 is described with reference to FIG. 4. As FIG. 4 illustrates, a bucket 112 is controllably connected to the work machine 102 by a plurality of linkages 110, notably a boom 402 and a stick 404. Each linkage 110 is adapted to pivot about an attachment to one of another linkage 110, the bucket, 112, and the work machine 102. For example, the boom 402 is adapted to pivot about the work machine 102, the stick 404 is adapted to pivot about the boom 402, and the bucket 112 is adapted to pivot about the stick 404.

A plurality of linkage position sensors 406 are located on the work machine 102 to sense the pivotal, i.e., angular, movement of each of the boom 402, stick 404, and bucket 112. For example, a linkage position sensor 406a is located to sense the angular movement of the boom 402 relative to the work machine 102, a linkage position sensor 406b is located to sense the angular movement of the stick 404 relative to the boom 402, and a linkage position sensor 406*c* is located to sense the angular movement of the bucket 112 relative to the stick 404.

The above description of an exemplary implement position determining system 210 is well known in the art and is one possible method to determine the position of the bucket 112 relative to the work machine 102. Alternatively, other methods could be used. For example, cylinder position sensors (not shown) could be used to sense the position of hydraulic cylinders (not shown) which control movement of the linkages 110.

Referring back to FIG. 2, a controller 202, located on the work machine 102, is adapted to receive position information from the machine position determining system 204, and to receive position information from the implement position determining system 210. The controller 202 is further adapted to provide the position information to a display 208, located on the work machine 102, to provide a visual display of a scaled image of the work site 106, the work machine 102, and the work implement 104 relative to the work machine 102. Movement of the work implement 104 relative to the work machine 102 is also shown, including movement of each linkage 110 relative to the work machine 102.

Figure 3:
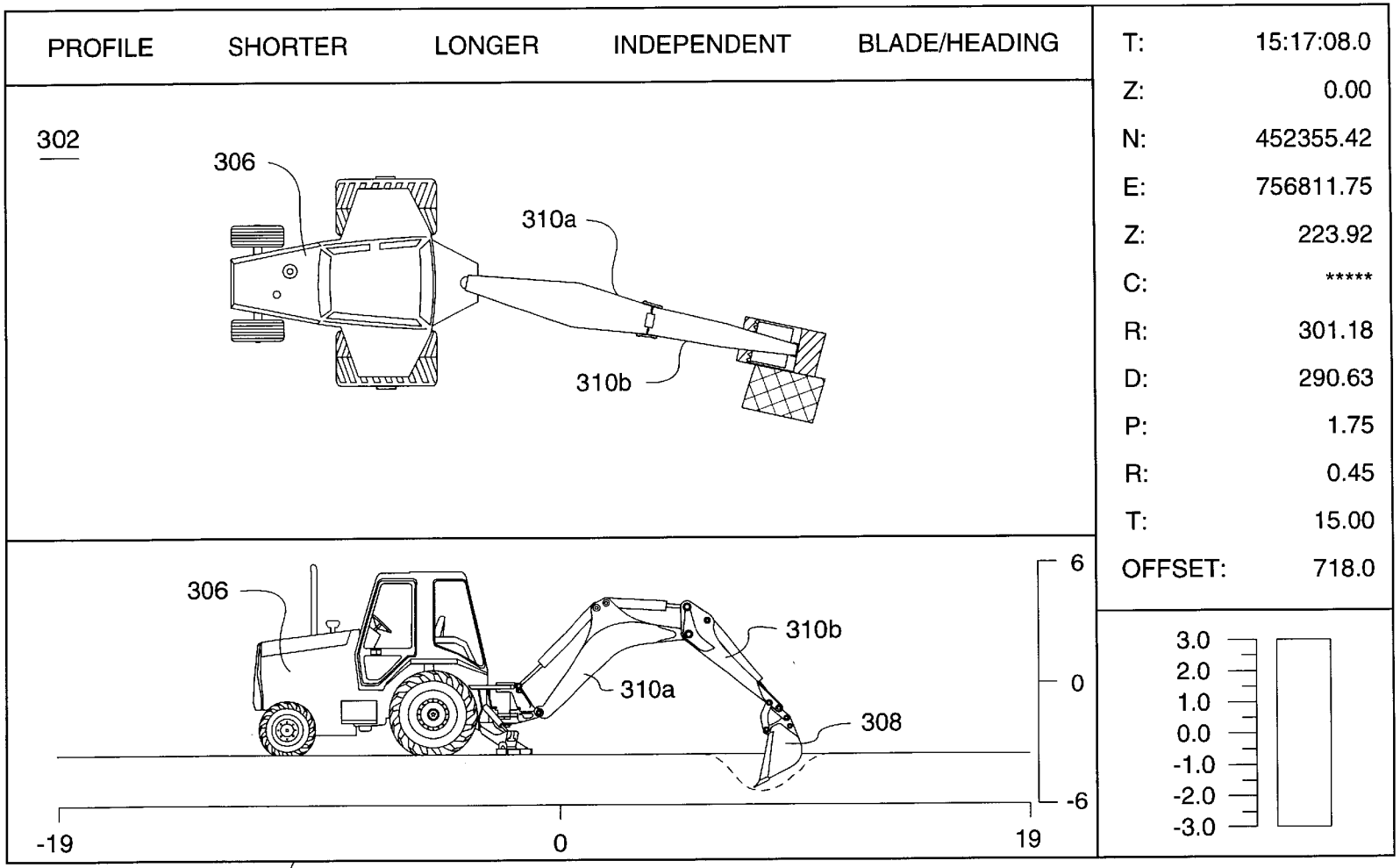
FIG. 3 is a diagrammatic illustration of a display as embodied in a preferred embodiment of the present invention.

Referring to FIG. 3, a diagrammatic illustration of an exemplary display 208 is shown. The display 208 depicts a top view 302 and a side profile view 304 of the work machine 102 and work implement 104 at the work site 106. The work machine 102 and the work implement 104 are represented in the display 208 as a work machine image 306 and a work implement image 308. In addition, the linkages 110 are represented by linkage images 310. More specifically, the boom 114 is represented by a first linkage image 310a, and the stick 116 is represented by a second linkage image 310*b*.

In the preferred embodiment of the present invention, each image, i.e., the work machine image 306, the work implement image 308, the first linkage image 310*a,* and the second linkage image 310*b,* are shown to scale with reference to the display of the work site 106. Furthermore, the movement of each of the work machine 102, the work implement 104, and each linkage 110 is represented in the display 208 to show movements of all relevant components of the work machine 102 with respect to the work site 106. Thus, by viewing the display 208, an operator of the work machine 102 is fully aware of movement of the work implement 104 relative to the work machine 102 and relative to the work site 106.

Figure 5:
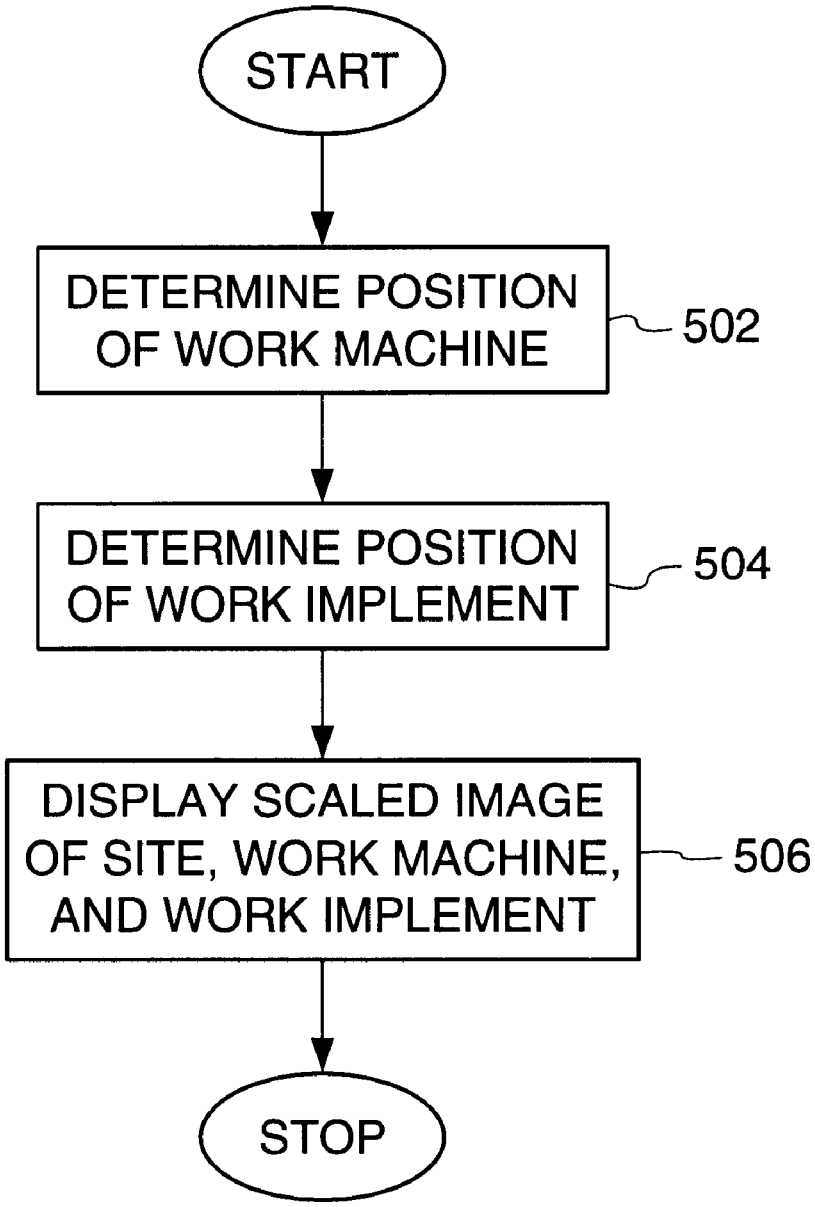
FIG. 5 is a flow diagram illustrating a preferred method of the present invention.

Referring to FIG. 5, a flow diagram illustrating a preferred method of the present invention is shown.

In a first control block 502, the position of the work machine 102 is determined relative to the work site 106, preferably by the use of the machine position determining system 204.

In a second control block 504, the position of the work implement 104 is determined relative to the work machine 102, preferably by the use of the implement position determining system 210.

In a third control block 506, a scaled image of the work site 106, the work machine 102, and the work implement 104 relative to the work machine 102 is displayed, wherein movement of the work implement 104 relative to the work machine 102 is shown.

Industrial Applicability

As an example of an application of the present invention, the images of FIG. 3 are shown as images representing a backhoe loader having a boom 114, stick 116, and bucket 112 controllably attached. As an operator of the backhoe loader performs work operations, e.g., excavating, the display 208 provides a scaled view of movement and position of the bucket 112 relative to the backhoe loader. Thus, the operator is not constrained by a limited view of the actual position and movement of the bucket 112. For example, the bucket 112, without a display 208, may be obscured from view when in a hole being dug, when in direct line with the linkages 110, or when too close to the backhoe loader itself to see the bucket 112 from the operator's position. In addition, the operator, by viewing the display 208, can easily determine the relative positions and movements of the boom 114 and stick 116 to aid in efficient control of movement of the bucket 112.

Other aspects, objects, and features of the present invention can be obtained from a study of the drawings, the disclosure, and the appended claims.

What is claimed is:

1. A method for providing a display of a work machine at a work site, the work machine having a work implement controllably attached, including the steps of:

determining a position of the work machine relative to the site;

determining a position of the work implement relative to the work machine; and displaying a scaled image of the site, the work machine, and the work implement relative to the work machine, wherein movement of the work implement relative to the work machine is shown.

2. A method, as set forth in claim 1, wherein the work implement is controllably attached to the work machine by a plurality of linkages, and further including the steps of:

determining the position of each linkage relative to the work machine; and displaying a scaled image of each linkage, wherein movement of each linkage relative to the work machine is shown.

3. A method, as set forth in claim 2, wherein displaying a scaled image includes the step of displaying at least a top view and a side profile view of the work machine at the work site.

4. An apparatus for providing a display of a work machine at a work site, the work machine having a work implement controllably attached, comprising:

a position determining system for determining a position of the work machine relative to the site;

means for determining a position of the work implement relative to the work machine;

a display located on the work machine; and a controller for receiving position information of the work machine and the work implement, and responsively delivering a signal to the display for displaying a scaled image of the site, the work machine, and the work implement relative to the work machine, wherein movement of the work implement relative to the work machine is shown.

5. An apparatus, as set forth in claim 4, wherein the work implement is controllably attached to the work machine by a plurality of linkages.

6. An apparatus, as set forth in claim 5, wherein the means for determining a position of the work implement relative to the work machine is adapted to determine the position of each linkage relative to the work machine.

7. An apparatus, as set forth in claim 6, wherein the controller is further adapted to display a scaled image of each linkage, wherein movement of each linkage relative to the work machine is shown.

8. An apparatus, as set forth in claim 4, wherein the display includes at least a display of a top view and a side profile view of the work machine at the work site.

9. An apparatus, as set forth in claim 4, wherein the position determining system includes a global position satellite (GPS) system.

10. An apparatus, as set forth in claim 6, wherein the means for determining a position of the work implement includes a plurality of linkage position sensors.

11. An apparatus for providing a display of an excavating machine at a work site, the excavating machine having a plurality of linkages and a bucket controllably attached, comprising:

a position determining system for determining a position of the excavating machine relative to the site;

a plurality of linkage sensors for determining a position of the bucket relative to the excavating machine;

a display on the excavating machine; and a controller for receiving position information of the excavating machine and the bucket, and responsively delivering a signal to the display for displaying a scaled image of the site, the excavating machine, and the bucket relative to the excavating machine, wherein movement of the bucket relative to the excavating machine is shown.

* * * * *